US010006652B2

(12) United States Patent
Jang et al.

(10) Patent No.: US 10,006,652 B2
(45) Date of Patent: Jun. 26, 2018

(54) EVAPORATIVE HUMIDIFIER

(71) Applicant: SAMSUNG ELECTRONICS CO., LTD., Suwon-si, Gyeonggi-do (KR)

(72) Inventors: Eom Ji Jang, Anyang-si (KR); Sung-June Cho, Suwon-si (KR); Jun Hyoun Kwon, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 74 days.

(21) Appl. No.: 15/182,132

(22) Filed: Jun. 14, 2016

(65) Prior Publication Data

US 2016/0370022 A1 Dec. 22, 2016

(30) Foreign Application Priority Data

Jun. 19, 2015 (KR) ..... 10-2015-0087645

(51) Int. Cl.

| | |
|---|---|
| ***F24F 6/00*** | (2006.01) |
| ***B01F 3/04*** | (2006.01) |
| ***F24F 6/06*** | (2006.01) |

(52) U.S. Cl.

CPC ..... *F24F 6/06* (2013.01); *B01F 3/04085* (2013.01); *F24F 2006/065* (2013.01)

(58) Field of Classification Search

CPC ..... B01F 3/04; B01F 3/04085; F24F 6/06
USPC ..... 261/83, 91, 94, 100
See application file for complete search history.

(56) References Cited

U.S. PATENT DOCUMENTS 2,061,646 A * 11/1936 Belden ..... F24F 6/06 261/92
2013/0113123 A1 5/2013 Ahn

FOREIGN PATENT DOCUMENTS

| | | | |
|---|---|---|---|
| JP | 2005282980 A | * 10/2005 | ..... F24F 6/06 |
| JP | 2010-84992 | 4/2010 | |
| JP | 2012-37144 | 2/2012 | |
| JP | 2014-66477 | 4/2014 | |
| KR | 10-2011-0022848 | 3/2011 | |
| KR | 10-2014-0056907 | 5/2014 | |
| KR | 10-2014-0078939 | 6/2014 | |
| WO | 2010/062005 | 6/2010 | |
| WO | 2014/010296 | 1/2014 | |

OTHER PUBLICATIONS

Extended European Search Report dated Dec. 19, 2016 from European Patent Application No. 16174640.9, 6 pages.

* cited by examiner

*Primary Examiner* — Robert A Hopkins
(74) *Attorney, Agent, or Firm* — Staas & Halsey LLP

(57) ABSTRACT

An evaporative humidifier includes a main body; a reservoir provided in the main body to store water; and a humidifying element assembly rotatably provided in the main body. The humidifying element assembly includes a humidifying element which is configured to absorb water and perform humidification, and a frame to support the humidifying element, the frame including at least one guider portion which guides the water of the reservoir toward one side surface of the humidifying element.

19 Claims, 9 Drawing Sheets

EVAPORATIVE HUMIDIFIER

CROSS-REFERENCE TO RELATED APPLICATIONS

This application claims the benefit of Korean Patent Application No. 10-2015-0087645, filed on Jun. 19, 2015 in the Korean Intellectual Property Office, the disclosure of which is incorporated herein by reference.

BACKGROUND

1. Field

Embodiments of the present disclosure relate to an evaporative humidifier which performs humidification by naturally evaporating water without using ultrasonic waves and a heater.

2. Description of the Related Art

An evaporative humidifier is a home appliance which is provided with a humidifying element which absorbs water and a blowing fan which forcibly circulates indoor air for humidifying dry indoor air by passing it through the humidifying element which absorbed water and discharging it back indoors, thereby performing humidification.

Generally, a humidifying element is rotatably provided inside a main body of an evaporative humidifier and is supplied with water stored in a reservoir while rotating. Conventionally, methods of supplying a humidifying element with water are mostly classified into two methods. A first method is a method in which a lower portion of the humidifying element is provided to be submerged in the water of the reservoir to directly absorb the water of the reservoir. A second method is a method in which the humidifying element is provided not to be submerged in the water and a water pocket provided outside the humidifying element scoops up the water from the reservoir to supply the water to an upper portion of the humidifying element.

The first method is not desirable in terms of humidification efficiency because the humidifying element is not sufficiently moistened due to lack of time for water to be absorbed, or only an outer portion is moistened even when the humidifying element is moistened. In addition, there is concern about propagation of mold or germs because the lower portion of the humidifying element is submerged in the water even when a humidification function is stopped.

By contrast, the second method may have better humidification efficiency and also be a cleaner method when compared to the first method. However, in a general case of a humidifying element using a water pocket, during a process of scooping up water from a reservoir and supplying the water to an upper portion of the humidifying element, a water loss such as the water scooped up and carried upward flowing to an outside of the humidifying element or the like needs to be prevented. Therefore, a structure for sealing the inside of each pocket becomes additionally necessary. To this end, the number of components increases, costs for injection molds and materials increase, and, in terms of usability at a user side, attachment, detachment, and cleaning become difficult. In addition, in the case of the water pocket, since the water drawn up is absorbed beginning from an outer portion of the humidifying element, it takes time until the humidifying element is sufficiently moistened and thus humidification efficiency is degraded.

SUMMARY

Therefore, it is an aspect of the present disclosure to provide an evaporative humidifier capable of saving costs for an injection mold and materials by removing a component for sealing which prevents loss of water carried by a water pocket in a rotary type evaporative humidifier, and having a structure which eases maintenance such as cleaning, etc. in terms of usability at a user side.

It is another aspect of the present disclosure to provide an evaporative humidifier capable of further increasing humidification efficiency by having a structure which allows an external and an internal shape of a guider to be designed in various shapes.

Additional aspects of the disclosure will be set forth in part in the description which follows and, in part, will be apparent from the description, or may be learned by practice of the disclosure.

In accordance with an aspect of an exemplary embodiment, there is provided an evaporative humidifier including a main body; a reservoir provided in the main body and configured to store water; and a humidifying element assembly rotatably provided in the main body, wherein the humidifying element assembly includes a humidifying element which absorbs water and performs humidification; and a frame provided with at least one guider portion which guides the water of the reservoir toward one side surface of the humidifying element.

The at least one guider portion may include a first portion submerged in the water stored in the reservoir; and a second portion which guides water collected at the first portion toward the center of the humidifying element.

The at least one guider portion may include a curved portion to guide water by a rotation of the humidifying element assembly.

The second portion may include a first surface which forms a bottom surface of a waterway and a second surface which forms one side wall of the waterway; and the second surface may be formed to face the one side surface of the humidifying element.

The first surface of the second portion may be formed to be downwardly inclined toward the one side surface of the humidifying element.

The at least one guider portion may be formed to protrude from the frame and is provided with a water inlet which faces a rotating direction to scoop up water by a rotation of the humidifying element assembly.

The first portion may include a separate water outlet to guide water toward an edge surface of the humidifying element.

The frame may include a first frame positioned at the one side surface of the humidifying element, a second frame portion positioned at the other side surface of the humidifying element, and a coupling device provided to couple the first frame portion and the second frame portion; and the coupling device may include a coupling protrusion provided at either the first frame portion or the second frame portion, and a coupling hole provided at the remainder.

The coupling device may be fixed by rotating the first frame portion and the second frame portion in opposite directions from each other after the coupling protrusion is inserted into the coupling hole.

The first frame portion or the second frame portion may include a guider rib which guides the first frame portion and the second frame portion to take a coupling position.

The humidifying element may be disposed so as not to be submerged in the water of the reservoir.

The evaporative humidifier may further include a driving motor which provides a rotational force to rotate the humidifying element assembly, wherein the frame of the humidifying element assembly includes a sawtooth portion engaged with a gear of a driving motor to receive the rotational force.

The frame may include at least one auxiliary guider portion which guides the water of the reservoir toward an edge surface of the humidifying element; and the at least one auxiliary guider portion may be formed between the at least one guider portion.

In accordance with an aspect of another exemplary embodiment, there is provided an evaporative humidifier including a main body; a reservoir provided in the main body and configured to store water; and a humidifying element assembly rotatably provided in the main body, wherein the humidifying element assembly includes a humidifying element which absorbs water and performs humidification; a frame which supports the humidifying element at both side surfaces; at least one first guider portion provided at the frame and configured to guide the water of the reservoir toward one side surface or both of the side surfaces of the humidifying element; and at least one second guider portion provided at the frame and configured to guide the water of the reservoir toward an edge surface of the humidifying element.

The frame may include a first frame portion which supports the humidifying element at the one side surface, a second frame portion which supports the humidifying element at the other side surface, and a coupling device provided to couple the first frame portion and the second frame portion; and the coupling device may include a coupling protrusion provided at either the first frame portion or the second frame portion, and a coupling hole provided at the remainder.

The coupling hole may be provided to serve a role of a water inlet through which the water of the reservoir is introduced into the first guider portion or the second guider portion.

The frame may include support ribs which connect from an outer portion of the frame to a central axis of the frame to support the humidifying element; and the support ribs may be provided to serve a role of a waterway of the first guider portion so that the water of the reservoir is guided toward the one side surface or both of the side surfaces of the humidifying element.

The frame may include a connecting rib which connects the support ribs; and the connecting rib may be provided to serve the role of the waterway of the first guider portion so that the water guided by the support rib is evenly distributed to the one side surface or both of the side surfaces of the humidifying element.

In accordance with an aspect of another exemplary embodiment, there is provided an evaporative humidifier including a main body; a reservoir provided in the main body and configured to store water; and a humidifying element assembly rotatably provided in the main body, wherein the humidifying element assembly includes a humidifying element which absorbs water and performs humidification; a first frame portion provided at one side of the humidifying element and including a first support rib provided at the first frame portion to support the humidifying element; and a second frame portion provided at the other side of the humidifying element, coupled to the first frame portion, and including a second support rib which supports the humidifying element and forms a waterway of the water scooped up from the reservoir, and at least one guider portion which supplies water to the humidifying element by scooping up the water of the reservoir and running the water toward the second support rib.

The second support rib may include a curved portion so that the water flows to a central portion of the humidifying element by a rotation of the humidifying element assembly; and the first support rib may include a curved portion which corresponds to the curved portion of the second support rib.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION

Figure 1:
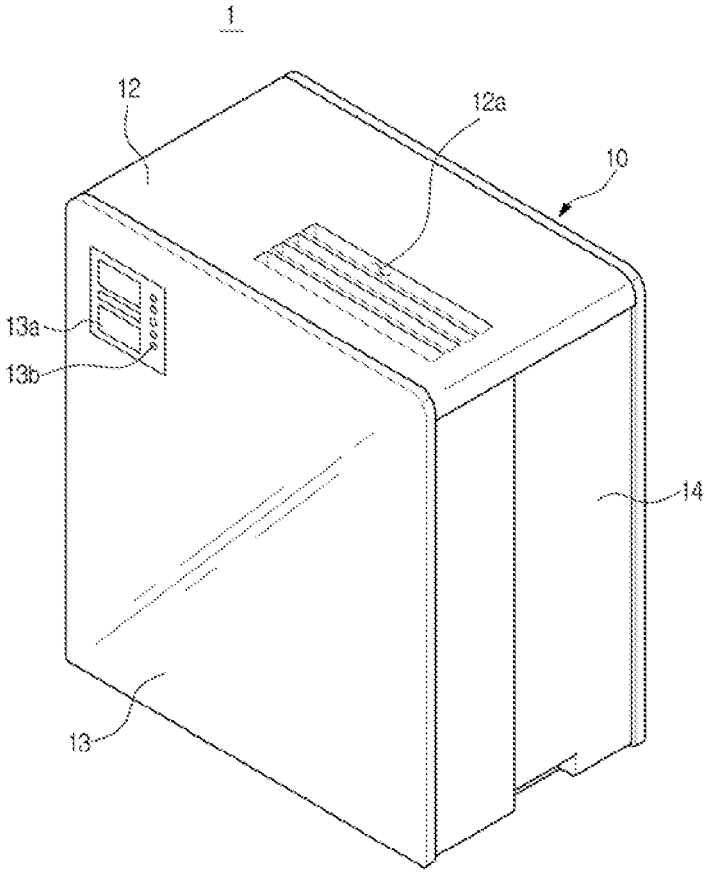
FIG. 1 is a front perspective view of an evaporative humidifier according to an embodiment of the present disclosure.

Reference will now be made in detail to the embodiments of the present disclosure, examples of which are illustrated in the accompanying drawings, wherein like reference numerals refer to like elements throughout.

Figure 2:
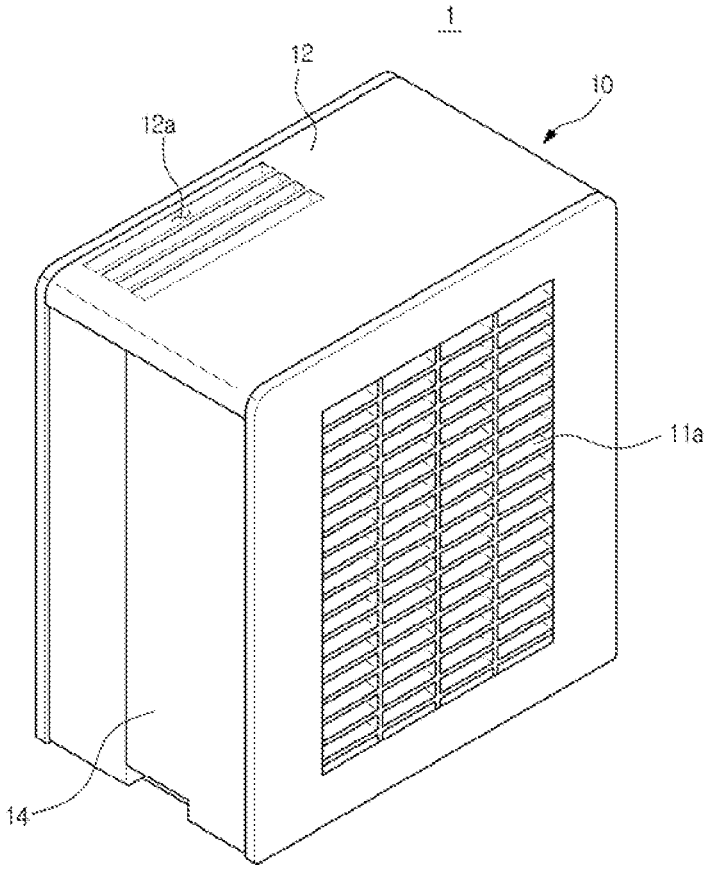
FIG. 2 is a rear perspective view of the evaporative humidifier of FIG. 1
Figure 3:
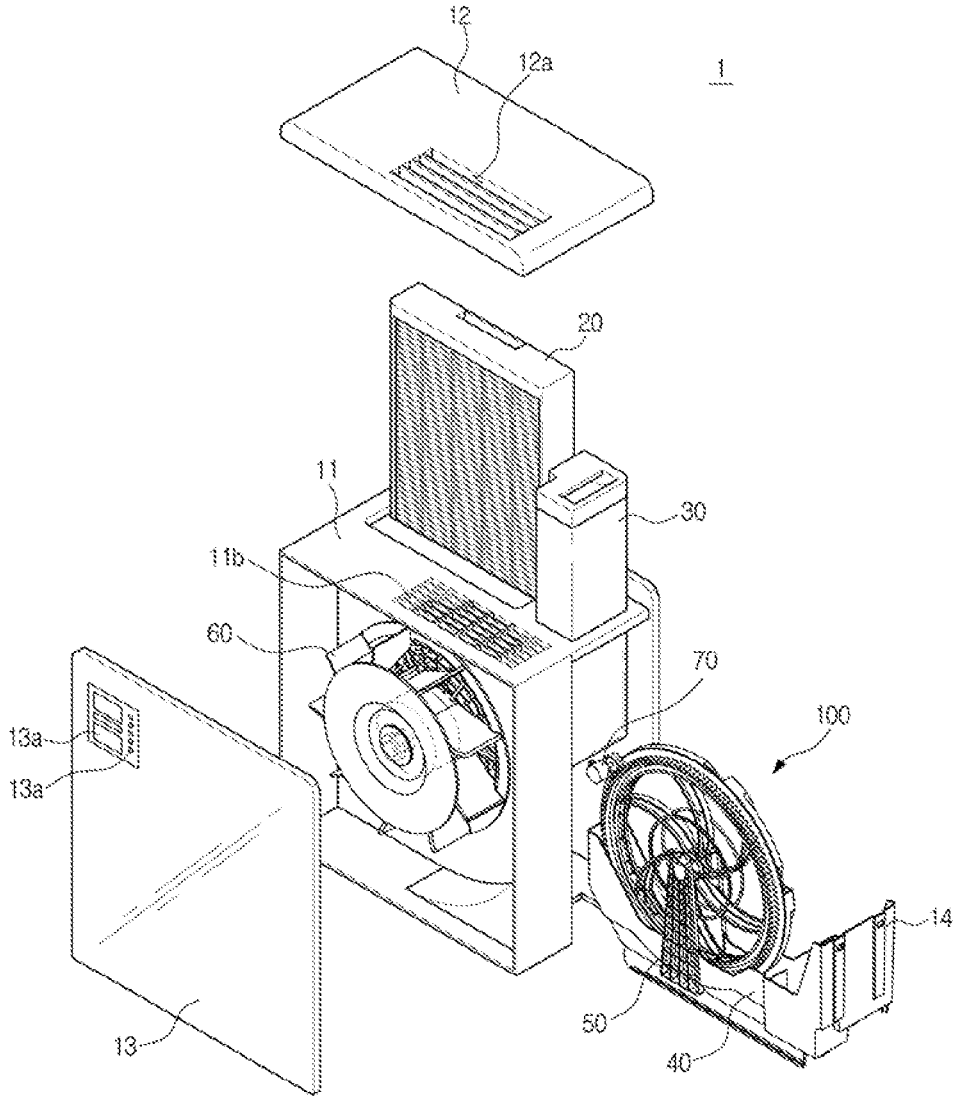
FIG. 3 is a front exploded perspective view of the evaporative humidifier of FIG. 1.

FIG. 1 is a front perspective view of an evaporative humidifier according to an embodiment of the present disclosure, FIG. 2 is a rear perspective view of the evaporative humidifier of FIG. 1, and FIG. 3 is a front exploded perspective view of the evaporative humidifier of FIG. 1.

Referring to FIGS. 1 to 3, an evaporative humidifier 1 according to the embodiment of the present disclosure includes a main body 10 which forms an exterior, a blowing fan 60 provided in the main body 10 to forcibly circulate air, a reservoir 40 provided in the main body 10 to store water, and a humidifying element assembly 100 rotatably provided in the main body 10 to perform humidification by evaporating water supplied from the reservoir 40.

The main body 10 includes a main housing 11, a front cover 13 coupled to a front opening of the main housing 11, a lateral cover 14 coupled to a lateral opening of the main housing 11, and an upper cover 12 coupled to an upper portion of the main housing 11.

An inlet 11*a* into which dry indoor air is introduced is provided at a rear surface of the main housing 11, and an outlet 11*b* through which humid air humidified in the main body 10 is discharged back indoors is provided at an upper surface of the main housing 11. A grill portion 12*a* which corresponds to the outlet 11*b* is provided at the upper cover 12.

Therefore, dry indoor air is introduced from the rear of the main body 10 into the main body 10, humidified in the main body 10, and then discharged in an upward direction of the main body 10. This forced air circulation may be formed by a blowing fan 60. Accordingly, the blowing fan 60 may be a centrifugal fan.

A display unit 13*a* which displays various types of information of the evaporative humidifier 1 and an operating unit 13*b* which operates various functions of the evaporative humidifier 1 are provided at the front cover 13.

The humidifying element assembly 100 may be rotatably supported by a support frame 50. The humidifying element assembly 100 may be rotated by receiving a rotational force from a driving motor 70. The humidifying element assembly 100 is detachable from the support frame 50. The support frame 50 may be coupled to the reservoir 40.

Therefore, the reservoir 40 and the humidifying element assembly 100 may be installed in or detached from the main body 10 in a lateral direction after detaching the lateral cover 14. Configurations of the humidifying element assembly 100 will be described in detail below.

Meanwhile, the evaporative humidifier 1 may further include a filter unit 20 which purifies air introduced into the main body 10, and a water container 30 for supplying water to the reservoir 40. The filter unit 20 may include a dust collecting filter, a deodorizing filter, etc., and thus the evaporative humidifier according to the embodiment of the present disclosure may also perform an air cleaning function. The filter unit 20 and the water container 30 may be installed in or detached from the main body 10 in a vertical direction after detaching the upper cover 12.

Figure 4:
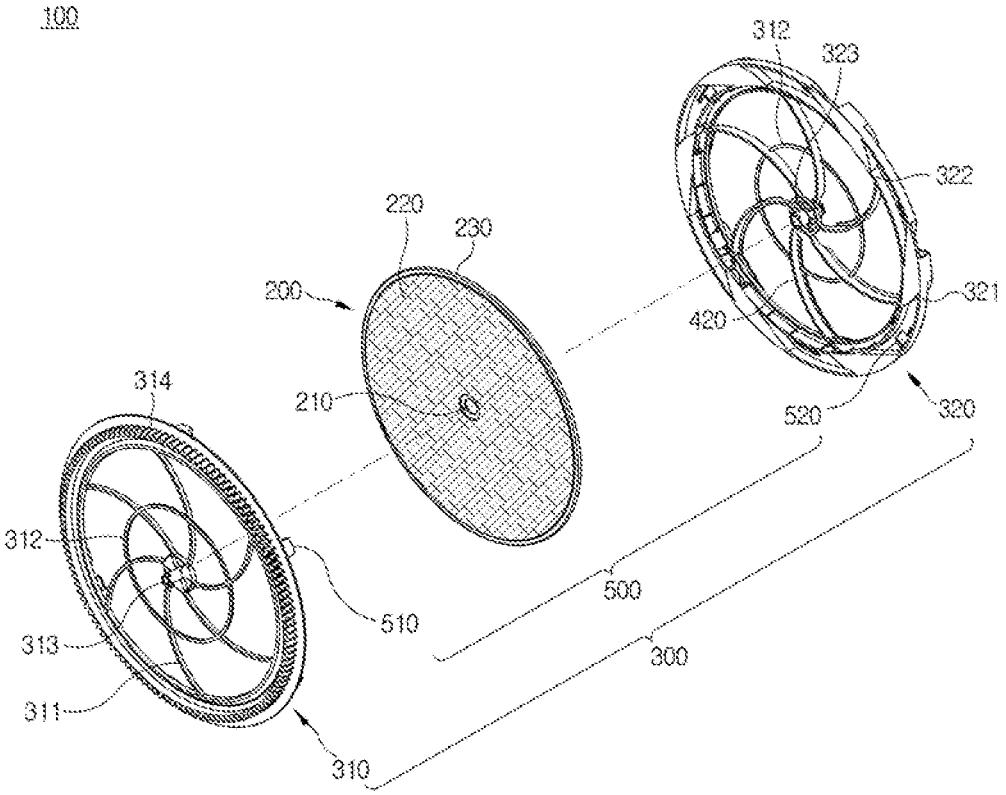
FIG. 4 is a front exploded perspective view of the humidifying element assembly of the evaporative humidifier of FIG. 1.
Figure 5:
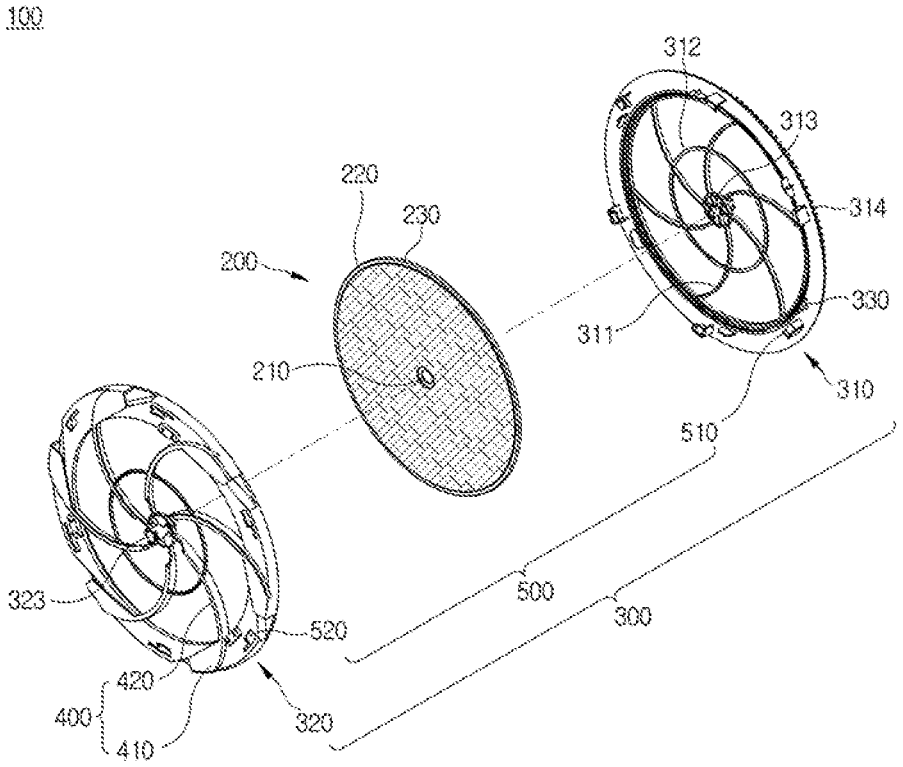
FIG. 5 is a rear exploded perspective view of the humidifying element assembly of FIG. 4.
Figure 6:
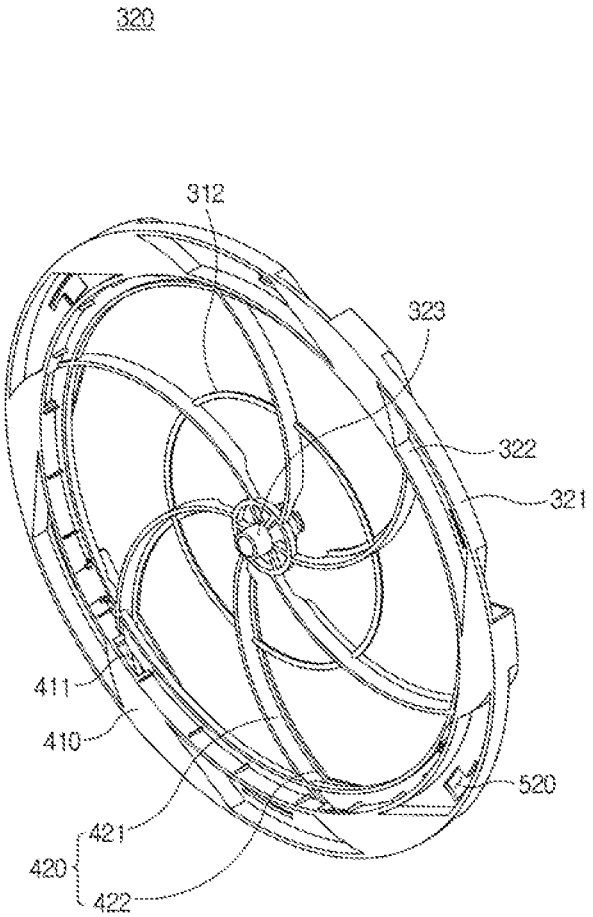
FIG. 6 is a front perspective view in which a second frame portion of FIG. 4 is enlarged.
Figure 7:
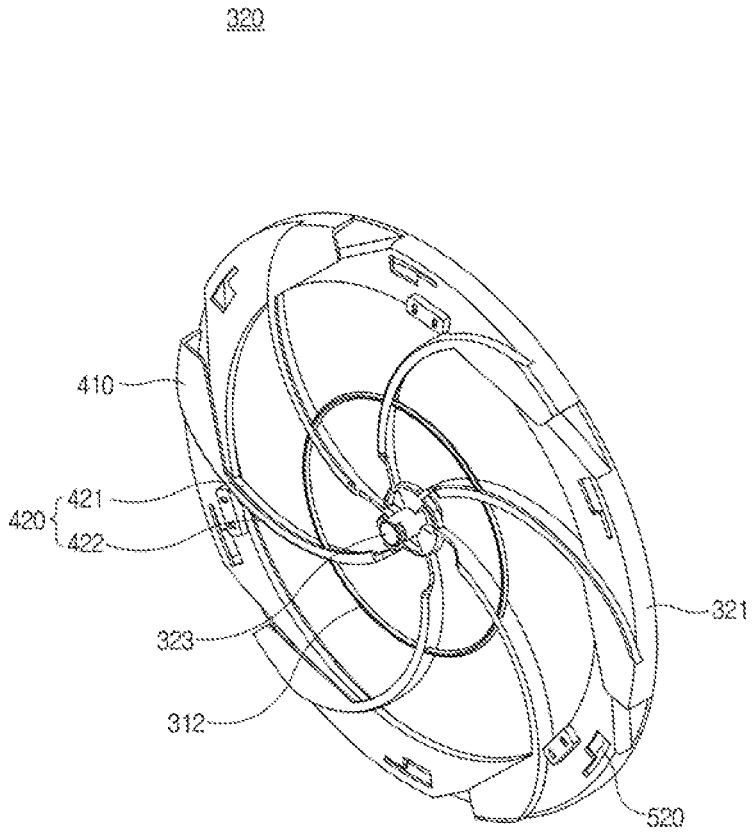
FIG. 7 is a rear front view in which the second frame portion of FIG. 5 is enlarged.

FIG. 4 is a front exploded perspective view of the humidifying element assembly of the evaporative humidifier of FIG. 1, and FIG. 5 is a rear exploded perspective view of the humidifying element assembly of FIG. 4. FIG. 6 is a front perspective view in which a second frame portion of FIG. 4 is enlarged, and FIG. 7 is a rear front view in which the second frame portion of FIG. 5 is enlarged.

A detailed configuration of the humidifying element assembly 100 of the evaporative humidifier according to the embodiment of the present disclosure will be described with reference to FIGS. 4 to 7.

The humidifying element assembly 100 may include a humidifying element 200 which absorbs water and performs humidification, and a frame 300 which supports the humidifying element 200. The frame 300 may include a first frame portion 310 and a second frame portion 320 respectively provided in front of and behind the humidifying element 200.

The humidifying element 200 may have a fiber material and a substantially disk shape. The humidifying element 200 is supplied with water from a guider portion 400 provided at the second frame portion 320 which guides water of the reservoir 40, retains the water, and performs humidification on air passing through the humidifying element 200.

Here, impurities such as dust or the like included in the air are filtered by the humidifying element 200, and only pure air may pass through the humidifying element 200. Therefore, the humidifying element 200 may perform a filtering function as well as a humidification function.

Meanwhile, each of the first frame portion 310 and the second frame portion 320 may have a disk shape having a radius roughly greater than that of the humidifying element 200. Each of the first frame portion 310 and the second frame portion 320 may be respectively formed of an injection-molded resin material. In addition, although it will be described below, the first frame portion 310 and the second frame portion 320 may be easily injection-molded by an upper mold and a lower mold which are vertically detached from each other and do not require complicated separate molds such as a slide core.

Rotation shafts 313 and 323 are respectively provided at the first frame portion 310 and the second frame portion 320, and a through hole 210 through which the shafts 313 and 323 pass may be provided at the humidifying element 200. The shafts 313 and 323 may be rotatably supported by the support frame 50 (see FIG. 3).

A sawtooth portion 314 may be provided at an outer portion of the first frame portion 310 to receive the rotational force from the driving motor 70. However, unlike the embodiment, the sawtooth portion 314 may alternatively be provided at the second frame portion 320.

The frame 300 may support the humidifying element 200 and include the guider portion 400 which supplies water to the humidifying element 200. Although the guider portion 400 is provided at the second frame portion 320 in the embodiment, the guider portion 400 may be provided at the first frame portion 310 or at each of the first frame portion 310 and the second frame portion 320.

The guider portion 400 may include a first portion 410 submerged in the water stored in the reservoir 40, and a second portion 420 formed at an inner side of the first portion 410 to guide the water toward the center thereof, that is, toward the through hole 210, of the humidifying element 200.

The second portion 420 may be formed at the center of the second frame portion 320 in a radial direction to have a size roughly corresponding to the size of the humidifying element 200, and roughly have a shape of a spoke so that air may pass through the second frame portion 320. In addition, the second portion 420 may have a curved shape or include a curved portion at a part thereof so that water may flow toward the center of the humidifying element 200 along the second portion 420 by the rotation of the second frame portion 320. A curvature of the curved portion may be variously formed as needed. Although not shown in the drawings, the second portion 420 may also be formed as a straight line without having a curved portion or as a shape in which a plurality of straight lines are connected to each other.

The second portion 420 may include a first surface 421 which forms a bottom surface of a waterway in which the water flows, and a second surface 422 which forms one side wall of the waterway. The second surface 422 may be formed at a side which faces a side surface 220 of the humidifying element 200 so that the water flowing in the waterway is absorbed to the humidifying element 200 but does not leak to a side in which the humidifying element 200 is not disposed.

The first surface 421 of the second portion 420 may be downwardly inclined from the second surface 422 toward the side of the humidifying element 200 so that the water flowing in the waterway flows to the side surface 220 of the humidifying element 200.

The guider portion 400 may be formed to protrude from the second frame portion 320, and a water inlet which faces a rotating direction to scoop up the water of the reservoir by the rotation of the humidifying element assembly 100 may be provided at the first portion 410.

The water introduced into the first portion 410 may be absorbed to the side surface 220 of the humidifying element 200 through the second portion 420. In addition, the first portion 410 may also be provided with a separate water outlet 411 to guide water to an edge surface 230 of the humidifying element 200.

The first frame portion 310 may include support ribs 311 which support the humidifying element 200. The support ribs 311 may be formed at the center of the first frame portion 310 in a radial direction to have a size roughly corresponding to the size of the humidifying element 200 and also have a shape of spoke so that air may pass through the first frame portion 310. In addition, the support ribs 311 may include a curved portion which corresponds to the curved shape of the second portion 420 of the guider portion 400 of the second frame portion 320 to minimize a flow resistivity of the air passing through the frame 300 and the humidifying element 200. Although not shown in the drawings, the support ribs 311 may also be formed as a straight line without having a curved portion, or as a shape in which a plurality of straight lines are connected to each other.

As described above, the guider portion 400 provided at the frame 300 may be provided at one or each of the first frame portion 310 and the second frame portion 320. Therefore, the second portion 420 of the guider portion 400 may serve roles of both of the support rib and the waterway of the water scooped up from the reservoir.

The frame 300 may include connecting ribs 312 which connect the support ribs 311 or the second portions 420 of the guider portion 400. The connecting ribs 312 serve not only a role of supporting the humidifying element 200 but also a role of reinforcing solidity of the support ribs 311. In addition, the connecting ribs 312 may be utilized as an additional waterway of the guider portion 400. Water which flows along the support ribs 311 or the second portion 420 of the guider portion may be more evenly distributed to the side surface of the humidifying element 200 by the connecting rib 312.

Meanwhile, the frame 300 may include a coupling device 500 to couple the first frame portion 310 and the second frame portion 320. The first frame portion 310 may have a coupling protrusion 510 which protrudes toward a side of the second frame portion 320, and the second frame portion 320 may have a coupling hole 520 into which the coupling protrusion 510 is inserted.

The coupling protrusion 510 and the coupling hole 520 may be respectively formed at the outer portion of the first frame portion 310 and an outer portion of the second frame portion 320. In addition, the coupling protrusion 510 and the coupling hole 520 may be formed opposite each other at the second frame portion 320 and the first frame portion 310, respectively.

After the coupling protrusion 510 is inserted into the coupling hole 520, the coupling protrusion 510 may be fixed to the coupling hole 520 when the first frame portion 310 and the second frame portion 320 are rotated in opposite directions from each other. To separate the first frame portion 310 and the second frame portion 320 from each other for cleaning or replacing the humidifying element 200, the first frame portion 310 and the second frame portion 320 may be easily separated from each other by rotating the first frame portion 310 and the second frame portion 320 in opposite directions from each other again.

In addition, the frame 300 may include a guide rib 330 which guides the first frame portion 310 and the second frame portion 320 to easily take coupling positions. The guide rib 330 may be formed either at the first frame portion 310 or at the second frame portion 320.

Other coupling structures may also be used besides the above described hook-coupling structure as long as the coupling structure is a coupling structure in which the first frame portion 310 and the second frame portion 320 are separable from each other.

The humidifying element 200 is provided so as not to be submerged in the water of the reservoir when the frame 300 is installed at the support frame 50. Accordingly, when the humidifying function is stopped, the humidifying element 200 may maintain cleanliness by maintaining a dry state.

As shown in FIGS. 4 to 7, the humidifying element assembly 100 may include six guider portions 400. However, there is no limit in the number of the guider portions 400.

The guider portion 400 accommodates the water of the reservoir 40 when the first portion 410 being located at the lower portion thereof is submerged in the water, and may supply water toward the side surface 220 of the humidifying element 200 when the water accommodated in the first portion 410 of the guider portion 400 flows toward the second portion 420 while the humidifying element assembly 100 rotates. Since this method does not absorb water from an outer portion to an inner portion of the humidifying element 200, but supplies water directly from the side surface to the humidifying element 200, the water may be quickly absorbed throughout the humidifying element 200.

To further improve a supplying speed of water to the humidifying element 200, water may also be supplied to the edge surface 230 of the humidifying element 200 through the water outlet 411 separately provided at the first portion 410.

Figure 8:
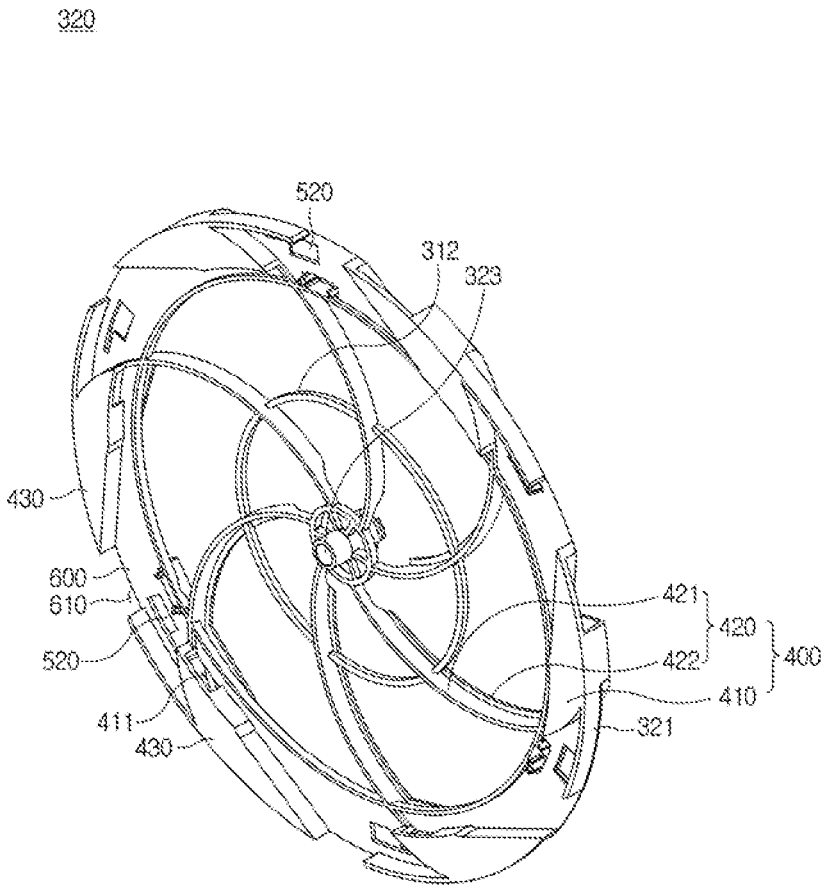
FIG. 8 is a front perspective view in which a second frame portion of an evaporative humidifier according to another embodiment of the present disclosure is enlarged.
Figure 9:
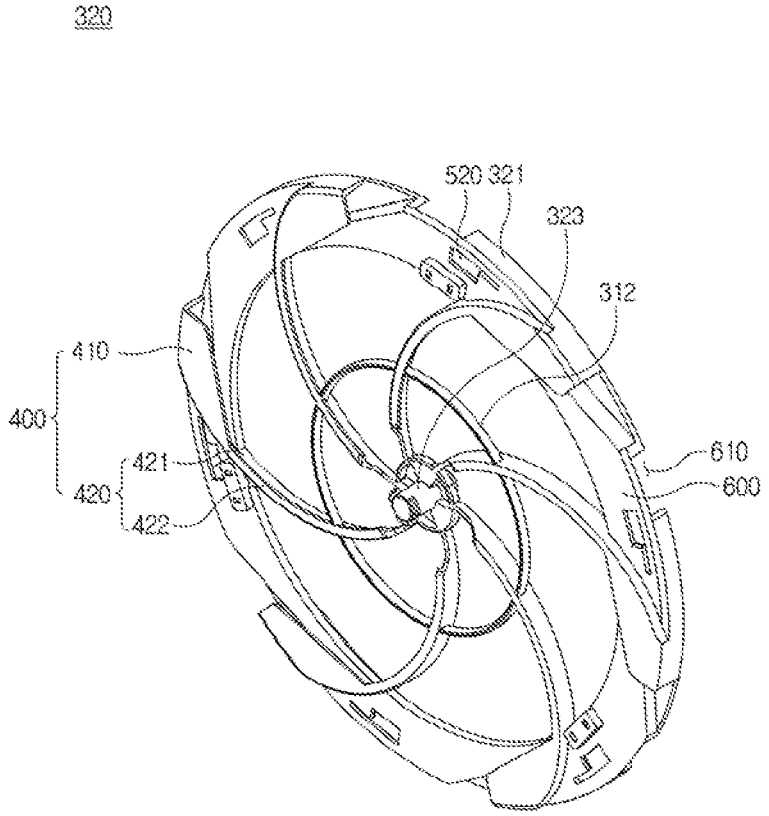
FIG. 9 is a rear perspective view in which the second frame portion of FIG. 8 is enlarged.

FIG. 8 is a front perspective view in which a second frame portion of an evaporative humidifier according to another embodiment of the present disclosure is enlarged, and FIG. 9 is a rear perspective view in which the second frame portion of FIG. 8 is enlarged.

According to FIGS. 8 and 9, a frame 300 of a humidifying element assembly 100 may further include an auxiliary guider portion 600 which guides water to be supplied to an edge surface 230 of a humidifying element 200. The auxiliary guider portion 600 may be provided between guider portions 400.

A second frame portion 320 illustrated in FIGS. 8 and 9 has the same configurations as the second frame portion 320 of FIGS. 4 to 7 except that the auxiliary guider portion 600 is additionally formed. Therefore, descriptions on the same configurations will be omitted.

Specifically, the auxiliary guider portion 600 may be formed at the second frame portion 320 of the frame 300 in which the guider portion 400 is provided. The auxiliary guider portion 600 may have a water inlet 610 formed by cutting an edge surface 321 of the second frame portion 320 without a separate protruding shape. In addition, among coupling devices 500 of a first frame portion 310 and the second frame portion 320, a coupling hole 520 may be utilized as an additional water inlet. However, the coupling hole 520 needs to be provided at a position at which the coupling hole 520 is submerged in water of a reservoir 40 when the coupling hole 520 is located at a lower side.

The water introduced through the water inlet 610 and the coupling hole 520 may be absorbed to the edge surface 230 of the humidifying element 200 by utilizing an outer wall 430 of the guider portion 400 as a guide.

When compared to an inside structure of the second frame portion 320 as illustrated in FIGS. 4 to 7, an inside flange 322 which facilitates installation of the humidifying element 200 may be removed in the second frame portion 320 illustrated in FIGS. 8 and 9 to form the auxiliary guider portion 600.

As is apparent from the above description, the evaporative humidifier in accordance with the embodiment of the present disclosure has an advantage in that costs of materials and injection molds can be saved because a component for sealing is not necessary.

In addition, the evaporative humidifier in accordance with the embodiment of the present disclosure has an advantage in that usability at a user side can be improved because components are simply attachable and detachable, and the number of components which need to be cleaned is reduced.

Further, the evaporative humidifier in accordance with the embodiment of the present disclosure has an advantage in that humidification efficiency can be increased because water scooped from the reservoir is naturally supplied along the guiders and is absorbed to the humidifying element according to the rotation of the motor.

The scope of the present disclosure is not to be construed as limited to the embodiments set forth herein. It should be appreciated by those skilled in the art that changes may be made to these embodiments without departing from the principles and spirit of the disclosure, the scope of which is defined in the claims and their equivalents.

What is claimed is:

1. An evaporative humidifier comprising:
a main body;
a reservoir provided in the main body to store water; and
a humidifying element assembly rotatably provided in the main body,
wherein the humidifying element assembly includes
a humidifying element which is configured to absorb water and perform humidification; and
a frame to support the humidifying element, the frame including at least one guider portion which guides the water of the reservoir toward one side surface of the humidifying element,
wherein the at least one guider portion includes
a first portion configured to be submerged in the water stored in the reservoir; and
a second portion to guide water collected at the first portion toward the center of the humidifying element.

2. The evaporative humidifier of claim 1, wherein the second portion includes a first surface which forms a bottom surface of a waterway and a second surface which forms one side wall of the waterway; and
the second surface is formed to face the one side surface of the humidifying element.

3. The evaporative humidifier of claim 2, wherein the first surface of the second portion is formed to be downwardly inclined toward the one side surface of the humidifying element.

4. The evaporative humidifier of claim 1, wherein the at least one guider portion is formed to protrude from the frame and is provided with a water inlet which faces a rotating direction to scoop up water by a rotation of the humidifying element assembly.

5. The evaporative humidifier of claim 1, wherein the first portion includes a separate water outlet to guide water toward an edge surface of the humidifying element.

6. The evaporative humidifier of claim 1, wherein the humidifying element is disposed so as not to be submerged in the water of the reservoir.

7. The evaporative humidifier of claim 1, further comprising a driving motor which provides a rotational force to rotate the humidifying element assembly,
wherein the frame of the humidifying element assembly includes a sawtooth portion engaged with a gear of a driving motor to receive the rotational force.

8. An evaporative humidifier comprising:
a main body;
a reservoir provided in the main body to store water; and
a humidifying element assembly rotatably provided in the main body,
wherein the humidifying element assembly includes
a humidifying element which is configured to absorb water and perform humidification; and
a frame to support the humidifying element, the frame including at least one guider portion which guides the water of the reservoir toward one side surface of the humidifying element,
wherein the at least one guider portion includes a curved portion configured to guide water by a rotation of the humidifying element assembly.

9. An evaporative humidifier comprising:
a main body;
a reservoir provided in the main body to store water; and
a humidifying element assembly rotatably provided in the main body,
wherein the humidifying element assembly includes
a humidifying element which is configured to absorb water and perform humidification; and
a frame to support the humidifying element, the frame including at least one guider portion which guides the water of the reservoir toward one side surface of the humidifying element,
wherein the frame includes a first frame positioned at the one side surface of the humidifying element, a second frame portion positioned at the other side surface of the humidifying element, and a coupling device provided to couple the first frame portion and the second frame portion, and
the coupling device includes a coupling protrusion provided at either the first frame portion or the second frame portion, and a coupling hole provided at the remainder.

10. The evaporative humidifier of claim 9, wherein the coupling device is fixed by rotating the first frame portion and the second frame portion in opposite directions from each other after the coupling protrusion is inserted into the coupling hole.

11. The evaporative humidifier of claim 9, wherein the first frame portion or the second frame portion includes a guider rib which guides the first frame portion and the second frame portion to take a coupling position.

12. An evaporative humidifier comprising:
a main body;
a reservoir provided in the main body to store water; and
a humidifying element assembly rotatably provided in the main body,
wherein the humidifying element assembly includes
a humidifying element which is configured to absorb water and perform humidification; and
a frame to support the humidifying element, the frame including at least one guider portion which guides the water of the reservoir toward one side surface of the humidifying element,
wherein the frame includes at least one auxiliary guider portion which guides the water of the reservoir toward an edge surface of the humidifying element, and
the at least one auxiliary guider portion is formed between the at least one guider portion.

13. An evaporative humidifier comprising:

a main body;

a reservoir provided in the main body to store water; and a humidifying element assembly rotatably provided in the main body, wherein the humidifying element assembly includes a humidifying element configured to absorb water and perform humidification;

a frame which supports the humidifying element at both side surfaces of the humidifying element;

at least one first guider portion provided at the frame and configured to guide the water of the reservoir toward one side surface or both of the side surfaces of the humidifying element; and at least one second guider portion provided at the frame and configured to guide the water of the reservoir toward an edge surface of the humidifying element.

14. The evaporative humidifier of claim 13, wherein the frame includes a first frame portion which supports the humidifying element at the one side surface, a second frame portion which supports the humidifying element at the other side surface, and a coupling device provided to couple the first frame portion and the second frame portion; and the coupling device includes a coupling protrusion provided at either the first frame portion or the second frame portion, and a coupling hole provided at the remainder.

15. The evaporative humidifier of claim 14, wherein the coupling hole comprises a water inlet through which the water of the reservoir is introduced into the first guider portion or the second guider portion.

16. The evaporative humidifier of claim 13, wherein the frame includes support ribs which connect from an outer portion of the frame to a central axis of the frame to support the humidifying element; and the support ribs are configured to be a waterway of the first guider portion whereby the water of the reservoir is guided toward the one side surface or both of the side surfaces of the humidifying element.

17. The evaporative humidifier of claim 16, wherein the frame includes a connecting rib which connects the support ribs; and the connecting rib is configured as the waterway of the first guider portion whereby the water guided by the support rib is evenly distributed to the one side surface or both of the side surfaces of the humidifying element.

18. An evaporative humidifier comprising:

a main body;

a reservoir provided in the main body to store water; and a humidifying element assembly rotatably provided in the main body, wherein the humidifying element assembly includes a humidifying element configured to absorb water and perform humidification;

a first frame portion provided at one side of the humidifying element and including a first support rib provided at the first frame portion to support the humidifying element; and a second frame portion provided at the other side of the humidifying element and coupled to the first frame portion, the second frame portion including a second support rib which supports the humidifying element and forms a waterway of the water scooped up from the reservoir, and at least one guider portion which supplies water to the humidifying element by scooping up the water of the reservoir and guiding the water toward the second support rib.

19. The evaporative humidifier of claim 18, wherein the second support rib includes a curved portion so that the water flows to a central portion of the humidifying element by a rotation of the humidifying element assembly; and the first support rib includes a curved portion which corresponds to the curved portion of the second support rib.

* * * * *